United States Patent [19]

Bramfitt et al.

[11] Patent Number: 5,017,335

[45] Date of Patent: May 21, 1991

[54] MICROALLOYED STEEL AND PROCESS FOR PREPARING A RAILROAD JOINT BAR

[75] Inventors: Bruce L. Bramfitt; Steven S. Hansen, both of Bethlehem, Pa.

[73] Assignee: Bethlehem Steel Co., Bethlehem, Pa.

[21] Appl. No.: 374,264

[22] Filed: Jun. 29, 1989

[51] Int. Cl.[5] ..... C21D 7/13; C22C 38/06

[52] U.S. Cl. ..... 420/127; 420/128; 72/201; 148/320

[58] Field of Search ..... 420/127, 128; 148/320; 72/201

[56] References Cited

U.S. PATENT DOCUMENTS

| | | | |
|---|---|---|---|
| 3,173,782 | 3/1965 | Melloy et al. | 420/127 |
| 3,472,707 | 10/1969 | Phillips | 420/127 |
| 3,496,032 | 2/1970 | Shimizu et al. | 420/127 |
| 3,562,028 | 2/1971 | Heitmann et al. | 420/128 |
| 3,666,452 | 5/1972 | Korchynsky et al. | 420/127 |
| 3,982,969 | 9/1976 | Koros et al. | 420/127 |
| 4,806,177 | 2/1989 | Held et al. | 148/320 |

OTHER PUBLICATIONS

American Railway Engineering Association, "Specifications for High-Carbon Steel Joint Bars", 1969.

B. L. Bramfitt et al., "Development of Microalloyed Joint Bar", Bethlehem Steel Co. Research Department Report, dated Jul. 29, 1988.

*Primary Examiner*—Deborah Yee

*Attorney, Agent, or Firm*—Gregory Garmong; John Iverson

[57] ABSTRACT

A microalloyed, fully killed steel has a composition, in weight percent, of from about 0.20 to about 0.45 percent carbon, from about 0.90 to about 1.70 percent manganese, from about 0.10 to about 0.35 percent silicon, from about 0.01 to about 0.04 percent aluminum, from about 0.05 to about 0.20 percent vanadium, from about 0.008 to about 0.024 percent nitrogen, balance iron. The steel is particularly useful when hot rolled to a railway joint bar section, and air cooled. The resulting joint bar meets AREA specifications in the as-rolled condition, without the need for a reheat and oil quench heat treatment after rolling.

10 Claims, 2 Drawing Sheets

MICROALLOYED STEEL AND PROCESS FOR PREPARING A RAILROAD JOINT BAR

BACKGROUND OF THE INVENTION

This invention relates to steels, and, more particularly, to a microalloyed steel useful in railway joint bars.

Railway joint bar is a special steel section that is used to join two railroad rails together. The rails are placed end to-end on the ties, and anchored in place with spikes driven into the ties. This procedure holds the rails generally in place, but the ends of the rails would not remain properly aligned with each other without the use of the joint bar. Lengths of joint bar are fastened to the sides of lengthwise adjoining rails in an overlapping fashion so that the joint bar extends from one rail to the other, with bolts that pass through the joint bar and the rails. One length of joint bar is on the inside of the rails and a second length is on the outside of the rails. The joint bars hold the facing ends of the two rails in the end-to-end aligned position.

The joint bar final product must meet specifications established by the American Railway Engineering Association, known in the industry as AREA. The AREA specification requires a minimum yield strength of 70,000 pounds per square inch (psi), a mimimum tensile strength of 100,000 psi, a minimum total elongation of 12 percent, and a minimum reduction in area of 25 percent, and further requires that the steel pass a 90 degree longitudinal bend test.

For over 70 years, the joint bars have been made in one of two ways. In the first, a plain carbon steel having at least 0.45 percent (all compositional percents herein are by weight) carbon is hot rolled to the joint bar section and air cooled. In the second, a plain carbon steel having from 0.35 to 0.60 (preferably 0.45) percent carbon is hot rolled to the joint bar section, air cooled, and then reheated and oil quenched in a separate operation, to give it a higher strength than can be attained without the post-rolling heat treatment. The second approach is more widely used today, because it results in higher strength and better toughness of the final product.

The oil quenched carbon steel joint bar meets the specifications, but it is comparatively expensive to produce. The reheating and oil quenching heat treatment is an additional costly production step, and it would be preferable to have an acceptable joint bar that does not require such heat treatment during manufacturing. Additionally, even though the area specification does not include a toughness standard, the railroads have become more concerned with the toughness of rails and joint bars in recent years. The joint bars produced by the existing approach have acceptable toughness, but improvements in this important property are always welcome.

There, therefore, exists a need for an improved joint bar and a steel for its manufacture. Such a product would desirably not require expensive heat treating operations such as reheating and oil quenching, and would have properties improved over those available with existing processing. The present invention fulfills this need, and further provides related advantages.

SUMMARY OF THE INVENTION

The present invention provides a microalloyed steel particularly useful when processed by hot rolling into a railway joint bar. The joint bar meets AREA mechanical property specifications, and additionally exhibits toughness properties equal or superior to those of existing joint bars made by a process including oil quenching. The steel of the invention is processed to a joint bar by hot rolling and air cooling, without the need for subsequent reheating and oil quenching.

In accordance with the invention, a steel has a composition, in weight percent, consisting essentially of from about 0.20 to about 0.45 percent carbon, from about 0.90 to about 1.70 percent manganese, from about 0.10 to about 0.35 percent silicon, form about 0.01 to about 0.04 percent aluminum, from about 0.05 to about 0.20 percent vanadium, from about 0.008 to about 0.024 percent nitrogen, balance iron. Preferably, the carbon content is from about 0.25 to about 0.35 percent, resulting in excellent toughness. In a most preferred embodiment, the steel contains about 0.27 percent carbon, about 1.45 percent manganese, about 0.25 percent silicon, about 0.02 percent aluminum, about 0.12 percent vanadium, and about 0.15 percent nitrogen.

The steel of the invention is a fully killed steel, having a low oxygen content of less than about 100 parts per million. Such a composition may be achieved by, for example, vacuum degassing the steel, without the need for a high silicon content. In accordance with this aspect of the invention, a fully killed steel has a composition, in weight percent, consisting essentially of from about 0.20 to about 0.45 percent carbon, from about 0.90 to about 1.70 percent manganese, from about 0.01 to about 0.04 percent aluminum, from about 0.05 to about 0.20 percent vanadium, from about 0.008 to about 0.024 percent nitrogen, less than about 100 parts per million oxygen, balance iron.

In accordance with the processing aspect of the invention, a process for preparing a railroad joint bar comprises the steps of providing a steel having a composition, in weight percent, consisting essentially of from about 0.20 to about 0.45 percent carbon, from about 0.90 to about 1.70 percent manganese, from about 0.10 to about 0.35 percent silicon, from about 0.01 to about 0.04 percent aluminum, from about 0.05 to about 0.20 percent vanadium, from about 0.008 to about 0.024 percent nitrogen, balance iron; hot rolling the steel to a joint bar section; and cooling the hot rolled joint bar to ambient temperature in air, without heat treating the joint bar. The joint bar may be made with the steel that is fully killed without adding a high silicon content, as described above.

The present steel is a microalloyed steel, containing a small amount of vanadium to enhance the mechanical properties of the product. It is further a "killed" steel, containing a sufficient amount of silicon and aluminum to deoxidize the molten steel, or achieving a low oxygen content otherwise. The killed steel exhibits a finer as-rolled grain size than does a semi-killed steel, resulting in greater strength and toughness. Thus, the composition of the steel is tailored to achieve particular properties.

Other features and advantages of the invention will be apparent from the following more detailed description of the preferred embodiment, taken in conjunction with the accompanying drawings, which illustrates, by way of example, the principles of the invention.

DETAILED DESCRIPTION OF THE PREFERRED EMBODIMENT

Figure 1:
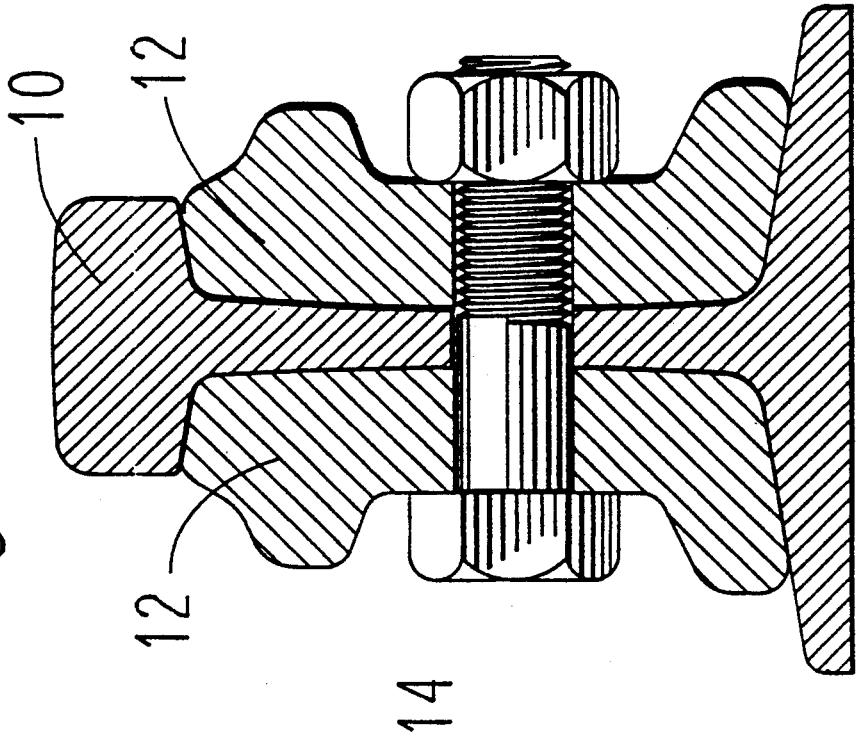
FIG. 1 is an end sectional view of a rail with joint bars bolted thereto.

The steel of the present invention is preferably used in the manufacture of joint bar used to join lengths of railroad rail together at their ends. FIG.1 illustrates a rail 10 having a joint bar 12 on either side thereof. A bolt 14 extends through bores in the joint bars 12 and the rail 10, firmly joining them together. In conventional practice, the joint bar is about 36–39 inches in length (the direction out of the plane of the drawing), has a maximum thickness of about 1½ inches, and has a maximum height of about 5 inches. As noted, the joint bar 12 must meet property specifications established by AREA.

The preferred steel of the invention has a composition in weight percent of 0.25–0.35 carbon, 0.90–1.70 manganese, 0.10–0.35 silicon, 0.01–0.04 aluminum, 0.05–0.20 vanadium, 0.008–0.024 nitrogen, with the balance iron. Incidental elements commonly found in steelmaking practice are acceptable, as long as they do not so adversely affect the steel that it cannot meet its required properties.

The steel is prepared by conventional steelmaking practice. Molten iron is formed from ores and additives in a blast furnace. Steel is processed from the molten iron using any convenient apparatus, preferably a baisc oxygen converter or an open hearth. The steel may also be processed in an electric furnace using scrap. After the appropriate steel composition is formed, it is either ingot or continuously cast. Rolling to the joint bar section, such as that shown in FIG. 1, is accomplished by hot rolling. A typical hot rolling practice includes reheating the slabs or ingots to a temperature of about 2150°–2400° F. Rolling typically is performed in 5 to 8 roughing and finishing passes of 5 to 30 percent reduction each, to go from a thickness of 4 to 4½ inches to a head thickness of about 1⅛ to 1½ inches. The finishing temperature is about 1700°–2000° F. At the conclusion of rolling, the joint bar section may be saw cut to length, or shipped to the customer as a long length. Fastening holes or slots are punched or drilled into the joint bar section prior to use.

The alloying elements utilized in the microalloyed steel of the invention are selected so that, in combination, they permit the steel to meet AREA specifications in the hot rolled condition. A separate austenitizing and oil quenching heat treatment, such as required for conventional plain carbon joint bar steels, is not needed to achieve acceptable properties. This modification to the processing is an important cost advantage. The cost of the heat treatment equipment involves a large capital expenditure, and the heat treatment adds significantly to the cost of the joint bar. The properties of the resulting steel actually exceed those of the plain carbon steels in some respects.

The carbon content of the steel is from about 0.20 to about 0.45 weight percent, preferably about 0.25–0.30 percent, and most preferably about 0.27 percent. If the carbon content of the steel is less than about 0.20 percent, there is an insufficient volume fraction of pearlite in the hot rolled steel product to maintain the desired strength level of 70,000 psi minimum yield strength and 100,000 psi mimimum tensile strength. The volume fraction of pearlite in the steel having 0.20 percent carbon is about 35 percent, and the volume fraction of pearlite in the steel having 0.45 percent carbon is 90 percent, both of which are sufficient to attain the required strength.

If the carbon content is increased above aboat 0.45 percent, the strength increases but the elongation and toughness of the steel are reduced. At such high carbon contents, the pearlite fraction becomes too high, and the ferrite fraction too low, to produce the required elongation. A steel of about 0.46 percent carbon has marginally insufficient elongation and reduction of area to meet the AREA specification. Additionally, above about 0.45 carbon the Charpy fracture toughness properties of the steel begin to decline, as evidenced by both an increased ductile-to-brittle transition temperature and reduced energy absorption at ambient temperature. By interpolation, a steel having 0.45 percent carbon meets the AREA specification, but has reduced fracture toughness. The upper limit of 0.45 percent carbon is thus established.

The preferred carbon content is above the minimum carbon content, but below the middle of the allowable range of 0.020–0.45 percent. Steels having carbon in the range of 0.25–0.30 percent have acceptable strength properties, exhibit good elongation, reduction in area and bend properties, and also exhibit excellent fracture toughness transition temperature and upper shelf energy. For carbon contents above 0.30 percent, AREA specifications are met, but the toughness properties are below those of the steels in the preferred range. A steel having 0.27 percent carbon at the middle of the preferred range, is most preferred.

Manganese is present to combine with sulfur in the form of manganese sulfide inclusions. The manganese also affects the ferrite transformation temperature. At least 0.90 percent manganese is required to maintain a sufficiently low ferrite transformation temperature to achieve a desirably fine microstructure (i.e., a fine ferrite grain size and pearlite interlamellar spacing). The fine microstructure in turn contributes to a better balance of strength and toughness in the steel. The manganese cannot be increased above about 1.70 percent, or microstructural banding is produced during solidification, particularly in a continuous casting machine. In the most preferred steel having about 0.27 carbon, the manganese is chosen as about 1.45 percent. This amount of the manganese balances the control of fine microstructure against the risk of microstructural segragation.

The steel of the invention is fully killed, having an oxygen content below about 100 parts per million, and preferably below about 40 parts per million. A fully killed steel can be achieved either through chemical reaction of the oxygen, typically with silicon and aluminum, to produce their respective oxides, or by removing the oxygen via a vacuum treatment. As indicated previously, the fully killed steel has a finer grain size, which contributes to increased strength.

For the preferred, less expensive, chemical deoxidation practice, both a relatively high silicon content and aluminum contribute to the deoxidation that produces the fully killed type of steel. Silicon is normally added to the molten steel first to remove the bulk of the oxygen in the molten steel. Aluminum is then added to deoxidize the steel to an even lower level. A silicon content below about 0.10 percent is unacceptable, as there is insufficient deoxidation and a semi-killed steel results. A silicon content in the range of about 0.10 to about 0.35 percent provides sufficient deoxidation power to reach a fully killed steel. At silicon contents above about 0.35 percent, silicates are formed which are present as particles in the microstructure. These particles produce a "dirty" steel whose fracture properties are reduced.

An alternative approach, wherein much less silicon is required, is to vacuum degas the steel to remove the majority of the oxygen, and then add aluminum to complete deoxidation.

The aluminum content must be at least about 0.01 percent, to ensure the final level of deoxidation and the desired internal quality of the steel. The aluminum content should not exceed about 0.04 percent, as its strong nitride forming capacity tends to reduce the nitrogen available for the formation of vanadium nitrides, one of the primary particulate strengtheners in the microstructure.

The permissible maximum aluminum content is determined by consideration of the available nitrogen. As will be discussed later, the maximum nitrogen content of the steel is about 0.024 percent. At this nitrogen content, and assuming a minimum soaking temperature of 2150° F. prior to hot rolling and an aluminum content of 0.04 percent, about 0.013 percent nitrogen remains in solution after the formation of aluminum nitride, and is therefore available to combine with vanadium to produce fine vanadium nitride precipitates during air cooling after rolling. For an aluminum content of about 0.01 percent, all of the nitrogen remains in solution to form vanadium nitride, again assuming a soaking temperature of 2150° F. On the other hand, at the minimum nitrogen level of 0.008 percent, about 0.007 percent nitrogen remains in solution at 2150° F. where the aluminum content is 0.04 percent; all the nitrogen (0.008 percent) remains in solution where the aluminum content is 0.01 percent. (Nitrogen solubility data is from the publication of Irvine, Pickering, and Gladman, "Grain Refined C-Mn Steels", J. Iron and Steel Institute, vol. 205, p. 161 (1967).) It is concluded that these free nitrogen levels are sufficient for the formation of enough vanadium nitride for strengthening purposes. Thus, the allowable maximum aluminum content of about 0.04 percent is closely tied to the vanadium nitride strengthening mechanism and the need to have sufficient available nitrogen content after reheating for operation of this mechanism. The preferred aluminum content is about 0.02 percent, to maximize the strengthening due to the vanadium nitride particulate, while achieving a fully killed steel.

Vanadium is present to provide vanadium nitride strengthening precipitates, which substitute in part for the strengthening due to pearlite relied upon in plain carbon steels to achieve an acceptable yield strength. If the vanadium content is below about 0.05 percent, there is insufficient strengthening to achieve the desired yield strength, that specified in the AREA specification in this case. If the vanadium is increase above about 0.20 percent, the strengthening effect saturates and no further increase is found. Further increases in vanadium are highly uneconomical, as the cost of vanadium is high. The preferred vanadium content is about 0.12 percent.

Since vanadium combines with nitrogen to form the vanadium nitride preciptates, sufficient nitrogen must be present to form enough precipitates to achieve the required strength levels. At a minimum solutionizing temperature of 2150° F., all vanadium and the nitrogen not reacted with the aluminum are in solution. To provide nitrogen for aluminum nitride formation at high temperature, and leave available nitrogen in solution for later combination with vanadium at low temperature, the nitrogen content must be at least about 0.008 percent. Lesser amounts results in isufficient yield in the final product due to an insufficient number of vanadium nitride precipitates. The nitrogen content should not exceed about 0.024 percent, as there is a degradation of elongation and toughness properties above this level due to uncombined nitrogen at lower vanadium and aluminum levels.

As the previous discussion indicates, the alloying elements of the steel act in cooperation to achieve the beneficial results of the invention. The elements and their amounts are in a balanced, cooperative relationship, and cannot be selected without regard to the other elements in most cases.

Several steels in accordance with the present invention were prepared as a basis of comparison with those previously in use for preparation of joint bar. Steels MA1–MA4 are microalloyed steels, while Pc1 is a conventional plain carbon steel previously used for joint bar applications. The compositions of the steels are as set forth in Table I:

TABLE I

| Code | C | Mn | Si | Al | V | N |
|---|---|---|---|---|---|---|
| MA1 | .46 | 1.35 | .30 | .035 | .11 | .019 |
| MA2 | .38 | 1.18 | .25 | .017 | .16 | .018 |
| MA3 | .25 | 1.40 | .22 | .010 | .17 | .016 |
| MA4 | .27 | 1.65 | .32 | .022 | .13 | .017 |
| PC1 | .50 | 0.92 | .23 | .018 | <.003 | .009 |

The steels MA1-MA3 were small 500 pound laboratory heats processed by laboratory hot rolling and air cooling, as previously discussed. The steel MA4 was a 10 ton laboratory heat processed by hot rolling and air cooling in the mill using standard production practices. The steel PC1 was a production heat processed by hot rolling and air cooling, in the same batch as the MA4 steel to ensure uniform practice. Samples were tested in the as-rolled condition. Other pieces were austenitized at 1800° F. for four hours and oil quenched, and samples were tested in this condition. The mechanical properties of the steels, as tested using the AREA approved procedures, are reported in Table II, which also shows the AREA standards for reference. In this Table II, YS is the yield strength in thousands of pounds per square inch (ksi), TS is the tensile strength in thousands of pounds per square inch (ksi), Elong is the total elongation at failure in percent over a two inch gauge length, Ra is the reduction in area at failure in percent, and Bend is a statement as to whether the steel passed a 90° longitudinal bend test around a radius equal to its own thickness. The notation "q" denotes PC1 austenitized and quenched specimens, and the notation "hr" denotes PC1 hot rolled specimens. The AREA specification values are minimum standards that an acceptable joint bar must meet.

TABLE II

| Code | YS ksi | TS ksi | Elong pct | RA pct | Bend |
|---|---|---|---|---|---|
| MA1 | 90.7 | 135.8 | 11.8 | 23.7 | No |
| MA2 | 91.1 | 132.2 | 14.5 | 36.5 | Yes |
| MA3 | 87.1 | 118.5 | 18.3 | 45.9 | Yes |

TABLE II-continued

| Code | YS ksi | TS ksi | Elong pct | RA pct | Bend |
|---|---|---|---|---|---|
| MA4 | 91.1 | 124.3 | 20.6 | 55.1 | Yes |
| PC1q | 86.1 | 128.5 | 19.4 | 48.4 | Yes |
| PC1hr | 58.4 | 113.6 | 18.9 | 38.3 | Yes |
| AREA | 70 | 100 | 12 | 25 | Yes |

The MA1 steel, having a carbon content above the permitted range, did not meet the elongation, reduction in area, and bend test specifications. The MA2, MA3, and MA4 steels met all requirements. The lower carbon MA3 and MA4 steels had a yield strength about the same as the MA2 steel, which is at the top end of the acceptable carbon range, but had significantly better elongation and reduction in area. This improved elongation and reduction in area behavior was judged more important than the slight reduction in tensile strength. Accordingly, the steels at the low end of the carbon range, such as MA3 and MA4, were judged most preferred, although the steels at the high end of the carbon range, such as MA2, are acceptable.

The PC1hr steel has unacceptable yield strength. The PC1q steel, typical of the previous approach in the industry meets the AREA standards, but the microalloyed steels of the present invention are equivalent or superior in most properties of interest in the AREA specification.

Figure 2:
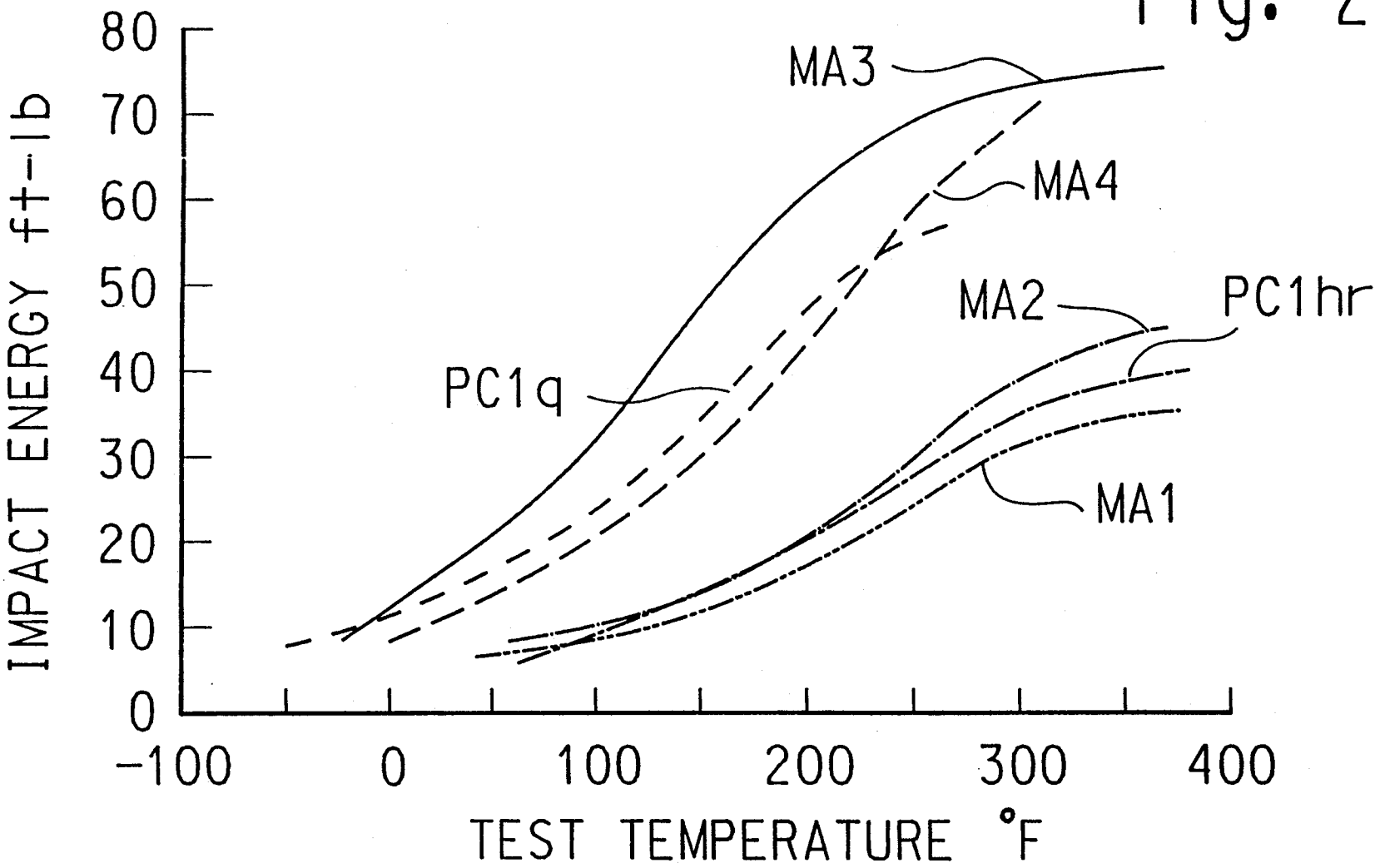
FIG. 2 is a graph of notch toughness as a function of temperature for several steels.

Additional testing in respect to toughness properties was conducted. Such properties are not addressed in the current AREA specification, but are of interest in the search for improved steels for various uses. FIG. 2 illustrates Charpy curves at a range of temperatures for the various steels. The microalloyed steels at the low end of the permitted carbon range, MA3 and MA4, exhibit superior properties to the MA1 and MA2 microalloyed steels. The MA3 steel has properties superior to those of the PC1q steel of the present practice, which is significantly more costly to produce due to the austenitizing and oil quenching required to attain its properties. The MA4 steel has properties roughly comparable with those of the PC1q steel.

When the toughness properties are considered in addition to the AREA specification properties reported in Table II and the results interpolated, it is apparent that microalloyed steels having about 0.25–0.30 carbon, are superior to the plain carbon, austenitized and oil quenched, steel currently used. The microalloyed steels at the high end of the carbon range achieve acceptable properties from the standpoint of the AREA specification, but do not achieve toughness properties as good as the low-carbon microalloyed steels and the prior steels.

Figure 4:
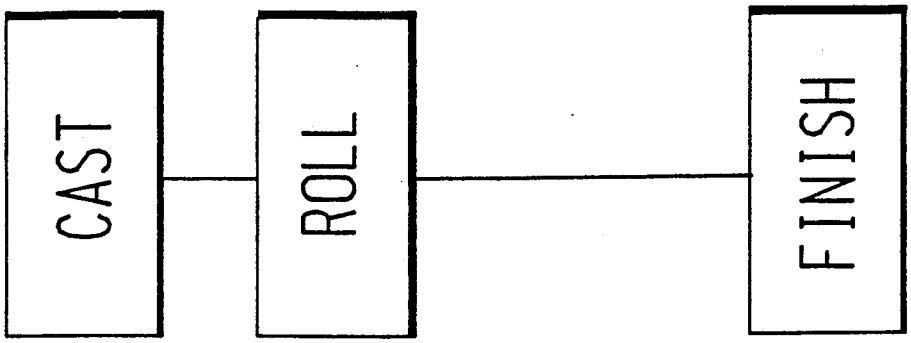
FIG. 4 is a flow chart for the preparation of the present steel.
Figure 3:
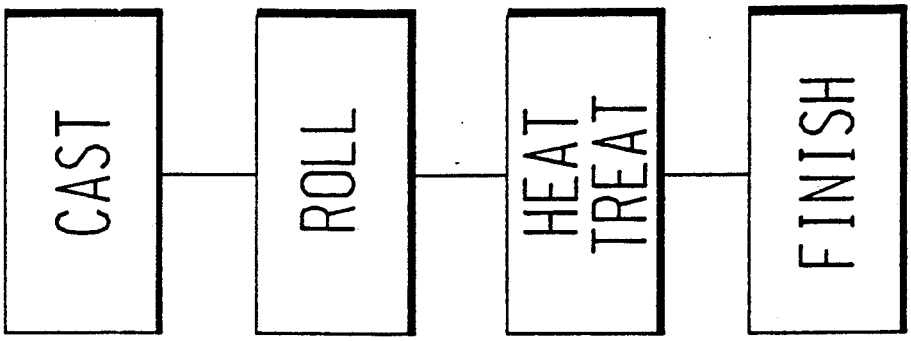
FIG. 3 is a flow chart for the preparation of the prior steel used for joint bars.

The steels of the invention achieve equivalent or superior properties at a reduced cost. As shown in FIG. 3, the prior approach requires casting, rolling, heat treating, and finishing of the joint bar. The present approach, FIG. 4, requires casting, rolling, and finishing, but not heat treating. The present steel, containing vanadium, has a slightly higher cost per ton of alloying elements, but avoiding the heat treatment step more than makes up for this extra cost. Studies have demonostrated that the cost of the present steel, when processed to a joint bar section ready for use, is about 10–15 percent less than the cost of the prior steel when similarly processed.

The present invention provides an advance in the arts of steels and joint bars. Precise control over alloying elements and amounts provide a material for joint bar applications that has superior properties and is less costly to produce, as compared with prior steels used for this purpose. Although particular embodiments of the invention have been described in detail for purposes of illustration, various modifications may be made without departing from the spirit and scope of the invention. Accordingly, the invention is not to be limited except as by the appended claims.

What is claimed is:

1. A fully killed steel having a composition, in weight percent, consisting essentially of from about 0.20 to about 0.45 percent carbon, from about 0.90 to about 1.70 percent maganese, from about 0.01 to about 0.04 percent aluminum, from about 0.05 to about 0.20 percent vanadium, from about 0.008 to about 0.024 percent nitrogen, less than about 100 parts per million oxygen, balance iron.

2. The steel of claim 1, wherein the silicon content of the steel is from about 0.10 to about 0.35 percent.

3. The steel of claim 1, wherein the carbon content of the steel is from about 0.25 to about 0.30 percent.

4. The steel of claim 1, wherein the steel contains about 0.27 percent carbon, about 1.45 percent manganese, about 0.25 percent silicon, about 0.02 percent aluminum, about 0.12 percent vanadium, and about 0.015 percent nitrogen.

5. A process for preparing a railroad joint bar, comprising the steps of:

providing a fully killed steel having a composition, in weight percent, consisting essentially of from about 0.20 to about 0.45 percent carbon, from about 0.90 to about 1.70 percent manganese, from about 0.10 to about 0.35 percent silicon, from about 0.01 to about 0.04 percent aluminum, from about 0.05 to about 0.20 percent vanadium, from about 0.008 to about 0.024 percent nitrogen, less than about 100 parts per million oxygen, balance iron;

hot rolling the steel to a joint bar section; and cooling the hot rolled joint bar to ambient temperature in air, without heating treating the joint bar.

6. The process of claim 5, wherein the joint bar has a maximum thickness of about 1½ inches.

7. The process of claim 5, wherein the joint bar has minimum yield strength of 70,000 pounds per square inch, a minimum tensile strength of 100,000 pounds per square inch, a minimum total elongation of 12 percent, and a minimum reduction in area of 25 percent.

8. A process for preparing a railroad joint bar, comprising the steps of:

providing a fully killed steel having a composition, in weight percent, consisting essentially of from about 0.25 to about 0.30 percent carbon, from about 0.90 to about 1.70 percent manganese, from about 0.01 to about 0.04 percent aluminum, from about 0.05 to about 0.20 percent vanadium, from about 0.008 to about 0.024 percent nitrogen, less than about 100 parts per million oxygen, balance iron;

hot rolling the steel to a joint bar section; and cooling the hot rolled joint bar to ambient temperature in air, without heat treating the joint bar.

9. The process of claim 8, wherein the silicon content of the steel is from about 0.10 to about 0.35 percent.

10. The process of claim 8, wherein the steel contains about 0.27 percent carbon, about 1.45 percent manganese, about 0.25 percent silicon, about 0.02 percent aluminum, about 0.12 percent vanadium, and about 0.015 percent nitrogen.

* * * * *

UNITED STATES PATENT AND TRADEMARK OFFICE

CERTIFICATE OF CORRECTION

PATENT NO. : 5,017,335

DATED : May 21, 1991

INVENTOR(S) : Bruce L. Bramfitt; Steven S. Hansen

It is certified that error appears in the above-indentified patent and that said Letters Patent is hereby corrected as shown below:

Column 8,

Claim 2 "The steel of claim 1, wherein the silicon content of the steel is from about 0.10 to about 0.35 percent," should read -- The steel of claim 1, wherein the composition, in weight percent, further consists essentially of silicon from about 0.10 to about 0.35 percent.

Signed and Sealed this

Tenth Day of September, 1996

Bruce Lehman

*Attest:*

BRUCE LEHMAN

*Attesting Officer*

*Commissioner of Patents and Trademarks*